United States Patent [19]

Josephson et al.

[11] 4,200,384

[45] Apr. 29, 1980

[54] PHOTOGRAPHIC APPARATUS FOR COUPLING TOGETHER ELEMENTS OF A SELF-DEVELOPING FILM UNIT

[75] Inventors: Donald G. Josephson, Wilmington; Duncan C. Sorli, Chelmsford, both of Mass.

[73] Assignee: Polaroid Corporation, Cambridge, Mass.

[21] Appl. No.: 15

[22] Filed: Jan. 2, 1979

[51] Int. Cl.[2] ..... G03D 5/02

[52] U.S. Cl. ..... 354/304; 354/86

[58] Field of Search ..... 354/84, 85, 86, 87, 354/301, 303, 304, 312

[56] References Cited

U.S. PATENT DOCUMENTS

| | | | |
|---|---|---|---|
| 3,788,205 | 1/1974 | Pasieka et al. | 354/304 |
| 3,854,812 | 12/1974 | Sorli | 354/301 |
| 4,009,031 | 2/1977 | Carlson et al. | 96/77 |
| 4,019,194 | 4/1977 | Cutler et al. | 354/312 |
| 4,156,568 | 5/1979 | Erikson | 354/304 |

OTHER PUBLICATIONS

U. S. Application Serial No. 957294, filed Nov. 2, 1978, inventor Mills.

*Primary Examiner*—L. T. Hix
*Assistant Examiner*—Alan Mathews
*Attorney, Agent, or Firm*—John S. Vale

[57] ABSTRACT

An improved photographic apparatus for coupling together separate film and print sheet elements of a self-developing film unit and facilitating the presentment of the coupled sheets to the entry of a processing device. The improvements include a displacing device for lifting a flap on a print leader to provide better access, for a coupling tab on the film sheet, to a tab receiving slot on the print leader; a pod cover device for covering a free trailing end of the pod to block the inadvertent insertion of the tab thereunder which would prevent accomplishment of the sheet coupling function; and a print hold back device responsive to movement of a cassette, holding a film sheet, along a portion of the apparatus for moving a hold back finger from a position blocking the path of travel of a print sheet toward the processor to an unblocking position.

17 Claims, 7 Drawing Figures

PHOTOGRAPHIC APPARATUS FOR COUPLING TOGETHER ELEMENTS OF A SELF-DEVELOPING FILM UNIT

BACKGROUND OF THE INVENTION

1. Field of the Invention

The present invention relates to the field of photography and, more specifically, to an improved photographic apparatus for coupling together sheet elements of a self-developing film unit and facilitating the presentation of the coupled sheet elements to the entry of a self-developing film unit process.

2. Description of the Prior Art

Certain types of self-developing film units of the diffusion transfer type, especially large format units such as 8×10 black and white or color or x-ray film units, are intentionally designed to have separate image recording and image receiving sheet elements. The image recording or photosensitive film sheet is placed in a cassette which is mounted on the back of a conventional or x-ray camera for exposure. Thereafter, the exposed film sheet is adapted to be located in superposed relation with the image recording or print sheet and coupled thereto in registered facing relation. The coupled sheets are then fed through a pair of pressure applying rollers in a processor which ruptures a pod containing a fluid processing composition and effects the distribution of the fluid between the superposed sheets for development and diffusion transfer. The two sheets are then peeled apart to reveal the positive print on the print sheet.

One system for effecting sheet coupling following exposure is disclosed in U.S. Pat. No. 4,019,194 issued to Norman Cutler on Apr. 19, 1977. In this system, the film sheet has a leader attached to its forward end and includes a forwardly projecting coupling tab thereon. The print sheet includes a leader having a tab receiving slot therein. The cassette includes an extra compartment for receiving the print sheet after film exposure. Once the print sheet is inserted into the cassette, the user manually inserts the tab through the slot on the print sheet to bring the two sheets into coupled relation. The cassette is then inserted into the entry of a commercially available processor for advancement through a pair of pressure rollers.

A more complex system is disclosed in commonly assigned copending application U.S. Ser. No. 957,294 filed by Loring Mills on Nov. 2, 1978. In this system, film and print sheets are bulk loaded into separate cassettes and the apparatus includes a rather complex sheet advancing system for mechanically bringing the film and print sheets into coupling relation for presentment to the processor rollers.

Perhaps more relevant to the present invention is the system disclosed in a commonly assigned copending application U.S. Ser. No. 841,888 filed by Herman Erikson on Oct. 13, 1977, now U.S. Pat. No. 4,156,568. In this system, an apparatus for coupling together sheet elements of the self-developing film unit and presenting them to the entry of a processor is provided in the form of an accessory or adapter for a commercially available large format processor of the type disclosed in the previously noted U.S. Pat. No. 4,019,194. The adapter fits into the entry of the processor and includes a tray for receiving the print sheet therein. The cassette is then inserted into the adapter and, as it approaches its fully inserted position over the print sheet in the tray a guide mechanism guides the film sheet coupling tab into a tab guide passageway between a flap of the print leader and the top surface of the pod of processing fluid. The tab advances along this passageway and through a tab receiving slot at the leading edge or fold line of the print leader. This system eliminates the manual loading of a print into the cassette yet it is not as complex as the mechanized system disclosed in the abovenoted application U.S. Ser. No. 957,294.

It will be noted, however, in this last mentioned system that the trailing end of the pod extends outwardly beyond the flap is not secured to the leader. Therefore, there is the possibility that the coupling tab may pass under the pod rather than over it and follow a path of travel toward the slot which is blocked by the leading end of the pod where it is secured to the print leader. Also, the flap over the top of the pod is in close proximity thereto and the guide means must be very accurate to insure tab insertion into the very narrow tab guide passageway. Therefore, it may be difficult to properly guide the tab into this passageway toward the slot if the film leader and tab have been distorted or mishandled prior to the coupling operation. This system also includes a print sheet hold back device in the form of a pair of spring fingers that prevent or restrain forward movement of the print sheet until it has been coupled with the film sheet. However, the hold back fingers are released by the engagement of the forwardly moving coupled sheet elements and may tend to lose their flex over a period of time and become ineffective.

Therefore, it is an object of the present invention to provide an improved photographic apparatus for coupling together sheet elements of a self-developing film unit and for facilitating the presentation of the coupled sheet elements to the entry of a processing unit wherein the improvement includes some means for lifting the flap away from the top surface of the pod to increase the dimensions of the tab guide passageway so that tab insertion through the slot becomes a less precise and critical operation.

It is yet another object of the invention to provide such an improved photographic apparatus that includes some means for covering the trailing end of the pod to block passage of the film tab thereunder which would preclude accomplishing the coupling function.

Another object of the invention is to provide such an improved apparatus having a hold back device that is moved from a blocking position to an unblocking position in response to engagement by a cassette as it approaches its fully inserted position in the apparatus rather than having the coupled sheets engage and displace a hold back device.

Other objects of the invention will, in part, be obvious and will, in part, appear hereinafter.

SUMMARY OF THE INVENTION

An improved photographic apparatus for coupling together sheet elements of a self-developing film unit and for facilitating the presentation of the coupled sheets to the entry of a self-developing film unit processor is provided herein to accomplish the stated objects of the invention.

The self-developing film unit includes a photosensitive image recording film sheet, initially provided in a cassette, including a leader portion that projects out of the cassette and includes a film coupling tab thereon.

The print sheet is of the type having a print leader, at its forward end, including a print leader flap folded back on the print leader along a forward fold line and terminating rearwardly in an unsecured trailing edge portion. A tab receiving slot is provided at the forward edge near the fold line. The print sheet also includes a rupturable container of processing fluid that is secured to the leader, under the flap, with its leading edge portion secured to the leader near the tab receiving slot. The trailing end portion of the container or pod is unsecured. The improved photographic apparatus embodying the present invention is of the type including a body; means for attaching the body to the processor in an operative position adjacent the entry thereof; a tray for receiving and supporting a print sheet in general alignment with the entry of the processor; a hold back device for engaging the leading edge of the print sheet in the tray and releasably restraining forward movement of the print sheet until the print and film sheets are coupled together; cassette seating means for receiving and positioning the cassette at a fully inserted position over the print sheet in the tray; and tab guide means for guiding the film tab between the underside of the flap and the upper surface of the pod and then through the tab receiving slot to effect coupling.

One improvement embodying the present invention includes providing means for displacing the print leader flap away from the upper surface of the rupturable container a greater distance than the distance the flap was initially spaced from the upper surface of the container, to define a tab guide passageway of minimum dimension, prior to the insertion of the tab into the print leader passageway to increase the dimension of the passageway in a direction generally transverse to the path of travel of the tab therethrough.

Another improvement of this invention includes the provision of a container or pod cover for automatically covering the trailing end of the pod or container in response to cassette insertion into the apparatus to prevent the tab from being guided inadvertently under the trailing end of the pod.

Another improvement includes the provision of a pair of hold back fingers that are moved from a blocking to unblocking position in response to movement of a cassette within the apparatus towards a fully inserted position.

Other improvements embodying the present invention and their specific structure and cooperation with other elements of the apparatus will be described hereinafter in the specification and set forth in the claims.

BRIEF DESCRIPTION OF THE DRAWINGS

For a fuller understanding of the nature and objects of the invention, reference should be had to the following detailed description taken in connection with the accompanying drawings wherein.

DESCRIPTION OF THE PREFERRED EMBODIMENT

Figure 1:
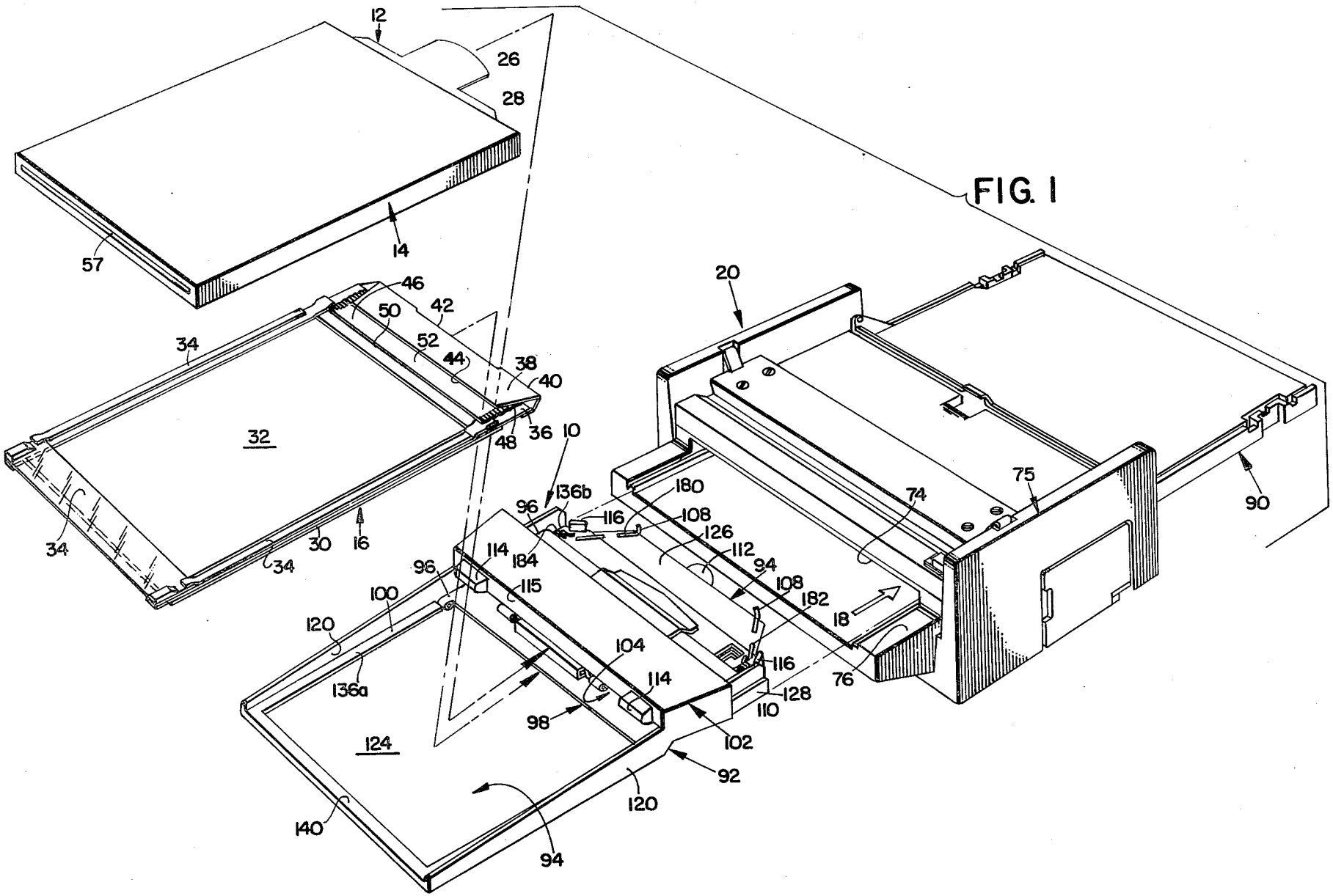
FIG. 1 is an exploded perspective view of the improved apparatus for coupling together elements of a self-developing film unit and facilitating the presentation of the coupled elements to a sheet receiving entry of a self-developing film unit processing device shown along with a print sheet element and a cassette holding a photosensitive film sheet.
Figures 2, 3:
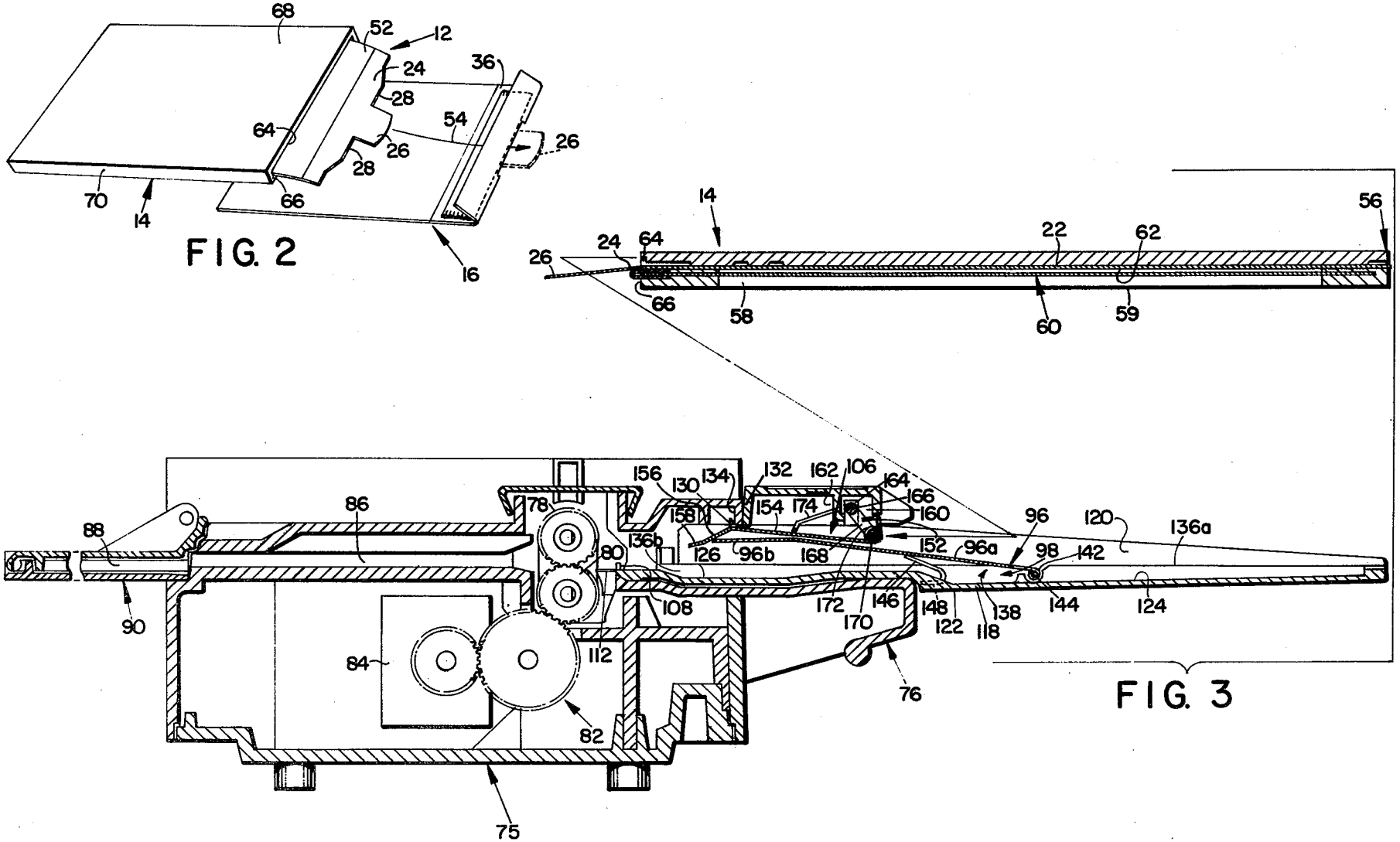
FIG. 2 is a pictorial drawing showing the path of travel of a leader tab on the film sheet through a receiving slot in the leader of the print sheet.
FIG. 3 is a cross-sectional view of the apparatus embodying the invention attached to the film processor prior to the insertion of a cassette (also shown) into the apparatus.

With reference to FIGS. 1 and 2, the present invention provides an improved photographic apparatus 10 for coupling together sheet elements of a self-developing film unit, including a photosensitive image recording film sheet element 12, provided in a holding cassette 14, and an image receiving print sheet element 16, and for facilitating the presentation of the coupled sheet elements 12 and 16 to the entry 18 of a commercially available self-developing film unit processor 20. In the illustrated embodiment, the sheet elements 12 and 16, cassette 14, and processor 20 are cofigured for use with 8×10 black and white or color or x-ray self-developing film units.

In use, the film sheet 12, held in cassette 14, is exposed with an 8×10 camera. After exposure, the print sheet 16 is placed in apparatus 10 connected to processor 20 adjacent entry 18. The cassette 14 is inserted into apparatus 10 and upon reaching a fully inserted position the two sheets are coupled together and presented to the bite line of a pair of pressure-applying rollers in processor 20 which advances the coupled sheets therebetween for processing. The sheet coupling and presentation functions will be described in detail later in the disclosure.

Film sheet 12 and image recording sheet 16 are of the self-developing type utilizing the well known diffusion transfer process for development and image transfer to sheet 16. For an example of such a film unit see U.S. Pat. No. 4,009,031.

The photosensitive image recording film sheet element 12 includes a multi-layer photosensitive film sheet 22 and a film leader 24 secured to and extending forwardly of the leading edge of sheet 22. Leader 24 includes a centrally disposed, forwardly extending coupling tab 26 and a pair of set back shoulder edges 28 extending laterally from the base of tab 26.

The image receiving print sheet element 16 includes a image receiving base sheet 30 having one or more image receiving layers thereon. It includes a rectangular image forming area 32 bordered by a rectangular spacer mask frame 34. Extending forwardly of the leading edge of base sheet 30 is a print leader 36 having a print leader flap 38 folded back onto the underlying portion of leader 36 along a leading edge forward line 40. Leader 36 includes a centrally disposed elongated leading edge slot 42 along the central portion of the fold line 40 for receiving therethrough the film leader coupling tab 26 but not the laterally extending shoulder edges 28 thereof.

Located on leader 36, and being partially covered by a rearwardly terminating flap trailing edge portion 44, is a laterally extending rupturable container or pod 46 having a supply of fluid processing composition therein. Pod 46 includes a leading edge seal 48 and a relatively weak trailing edge seal 50. It will be noted that, in a longitudinal direction toward the trailing end of base sheet 30, pod 46 is longer than flap 38 so that the trailing end portion of the pod 46 is uncovered. Preferably, the pod is secured to leader 36 near its leading edge seal 48 adajcent the fold line 40 and the trailing end portion of the pod is unsecured.

The flap 38 is normally located over a major portion of an upper surface 52 of pod 46 and is spaced a minimum distance therefrom. The underside of flap 38 and the facing upper surface 52 of pod 46 cooperate to define therebetween a tab guide passageway 54 (shown by arrow 54 in FIG. 2) leading to the tab receiving slot 42.

While the underside of flap 38 is somewhat spaced from upper surface 52, it is desirable that this space be of minimum dimensions to facilitate packaging of the print sheet element 16 in a minimum sized storage container for shipment. That is, the dimensions of the passageway 54, in a direction transverse to the path of travel of coupling tab 26 therethrough, is preferably provided as a minimum dimension for packaging density considerations.

Cassette 14 is configured to fit into the standard back of an 8×10 camera and also to fit into the apparatus 10 as will become apparent later.

The cassette includes a thin, generally parallelepiped shaped, book opening type, housing 56 for receiving film sheet 12 and a protective light opaque enclosing bag (not shown). After the film sheet 12 is located in cassette 14 the opaque bag is removed through a light sealed withdrawal slot 57 at the trailing end of the cassette. A light transmitting exposure aperture 58 in cassette forward wall 59 is initially covered by a removable dark slide 60. Internal structure of the cassette 14 locates the photosensitive image area of film sheet 22 at a predetermined exposure plane 62 behind the dark slide 60.

As shown in FIGS. 1 and 3, when the photosensitive portion of film sheet 12 is located within cassette 14, the leader 24 along with tab 26 and shoulders 28 extends outwardly and forwardly from a film exit slot 64 and a leading end wall 66 of cassette 14.

The other walls which define cassette 14 include a rear wall 68, a pair of cassette side walls 70 and a trailing end wall 72 having the bag withdrawal slot 57 therein.

As will be explained later in detail, the apparatus 10 is inserted into a generally rectangular entrance opening 74 located on processor 20 around the entry 18. The print sheet 16 is located in apparatus 10 and then the cassette 14 holding the exposed film sheet 12 is inserted into apparatus 10 over print sheet 16. As the cassette approaches its fully inserted position, the tab 26 of the film sheet is guided through passageway 54 and the coupling slot 42 on the print leader 36 and the tab is fed into the bite of a pair of processing rollers within processor 20. As best shown in FIGS. 1 and 3, processor 20 includes a receiving and support shelf 76, including rectangular opening 74 therein, for receiving and supporting apparatus 10 and a cassette 14 therein in operative relation to the entry 18 of processor 20.

Entry 18 comprises that space between the entry opening 74 and the bite line between a pair of upper and lower pressure applying rollers 78 and 80, respectively, mounted in main housing section 75 in alignment with opening 74.

Pressure rollers 78 and 80 are rotatably mounted and coupled together for simultaneous rotation in opposite directions to advance the coupled film and print sheets 12 and 16 therebetween while applying a compressive pressure progressively along the length of the coupled sheet elements to rupture pod 46 and distribute the fluid ejected therefrom between sheets 12 and 16 to initiate the well known development and diffusion transfer process. Rollers 78 and 80 are interconnected by elements of a multi gear gear train 82 which also couples the rollers to an electrical roller drive motor 84 mounted in the base of housing 75. From the exit side of the rollers 78 and 80, the superposed sheets 12 and 16 advance along a film passageway 86 in housing 75 and then along a connecting passageway 88 that extends out into a fold out receiving chamber 90 extending outwardly from the side of housing 75 opposite entrance opening 74.

For a more detailed explanation of the structure and operation of processor 20, reference may be had to commonly assigned U.S. Pat. No. 4,019,194 issued to Norman Cutler et al. on Apr. 19, 1977.

The apparatus 10 embodying the present invention includes a rigid body 92 having thereon: a print sheet receiving tray 94 on which a print sheet 16 is supported and initially restrained against forward movement until sheet coupling occurs and then is released for sliding forward movement into processor 20; a multi functional movably mounted rupturable container or pod cover device 96 which cooperates with tray 94 to define a print sheet passage and guideway 98 therebetween; cassette receiving and selecting means 100 for supporting cassette 14 over tray 94 and pod cover 96; a bridge structure 102 over pod cover device 96 which cooperates with certain structural elements and components of apparatus 10 to define a cassette passage and guideway 104; a multi functional, movably mounted, centrally disposed flap displacing device 106 mounted on the underside of bridge 102 so as to extend through cassette passageway 104 and being operative in response to cassette movement over the seating means to a fully inserted position to displace the print flap away from the pod to provide better access to the tab slot 42; a pair of print locating and hold back or restraining figures 108 at the leading end of tray 94 for initially restraining forward movement of a print sheet 16; and a pair of cassette operated restraining finger actuators 110 which are engageable by the cassette 14 as it approaches its fully inserted position to deflect fingers 108 out of the path of travel of the coupled film and print sheets 12 and 16. Other illustrated components of apparatus 10 include a pair of cassette insertion guide blocks 114, secured to and extending rearwardly from a bridge trailing end wall 115 over passageway 104, for guiding the cassette into operative relation with the cassette seating means 100 and into passageway 104, and a pair of cassette stops 116 near the forward end of tray 94 for defining the forwardmost location of the cassette's fully inserted position.

With reference to FIGS. 1 and 2, the rigid apparatus body 92 is primarily defined by a longitudinally extending bottom wall 118 which is tapered at its leading end to a reduced lateral dimension to facilitate insertion into the entry 18 of processor 20; a pair of upstanding side walls 120 provided at the lateral edges of bottom wall 118; and, of course, the previously noted bridge structure 102 located near the forward end of apparatus 10 in upstanding relation to the side walls 120.

As best shown in FIG. 3, the underside surface 122 of bottom wall 118 is contoured to fit in a snugly conforming manner to be illustrated concavely contoured horizontal support surface of the receiving and support shelf 76 of processor 20. The top surface 124 of bottom wall 118 includes certain contours and defines the floor of tray 94 for supporting print sheet 16. It will be noted that surface 124 terminates, forwardly, in an upwardly inclined sheet guide ramp 126. As best shown in FIG. 1, a forward portion 128 of the side walls 120, located forwardly of bridge 102, are indented somewhat in the lateral dimension so that they snugly fit into the processor passageway defined by the support shelf 76 having opening 74 therein.

As best shown in FIG. 3, the entire forward end of apparatus 10 is configured to snugly slide into and conform to the processor structure defining the entry 18. In a preferred embodiment, apparatus 10 includes a retaining spring clip 130 mounted on leading end wall 132 of bridge 102 and being configured to hook onto processor depending wall section 134 over entrance opening 74. It will be noted that the structure of walls 118 and 120, forwardly of bridge 102, and the leading end wall 134 and other side portions of bridge 102 along with one or more spring retaining clips 130 define means for releasably attaching or securing apparatus 10 in operative relation to processor 20.

The cassette seating means 100 includes a pair of split side rails 136 along with the interior vertical surfaces of the side walls 120. The rails 136 include a rear portion 136*a*, behind bridge 102, and a forward portion 136*b* located forwardly of the bridge. In the area under bridge 102, there is a gap 138 between rail sections 136*a* and 136*b* for receiving the pod cover 96. The seating means also includes a transverse rear rail 140 and the previously mentioned cassette stops 116 located at the leading end of the seating rail sections 136*b*.

The pod or container cover 96, the flap displacing device 106, and the print hold back device 108 will now be described structurally and functionally with reference to FIGS. 1 and 3–7.

Pod cover 96 is a plate-like sheet metal member located in gap 138 and being pivotally mounted at its trailing end for movement between a raised inoperative position shown in FIG. 3, for facilitating the insertion of a print sheet 16 through opening 98 to its operative position in tray 94, and a lowered operative position shown in FIGS. 4–7 where it covers the free trailing end of pod 96 to block movement of film tab 26 thereunder. In the raised inoperative position, cover 96 bears against and holds flap displacing device 106 in a raised storage position so that it also does not interfere with the insertion of a print sheet 16 into tray 94. In the lowered operative position, cover 96 serves a secondary function of providing a dividing plate between the cassette 14 and the underlying print sheet 16 as well as supporting the cassette as it moves forwardly over gap 138 toward the forward cassette support rails 136*b*.

Cover device 96 extends laterally across gap 38 between the side walls 120 and includes a flat rearward section 96*a* and a downwardly inclined forward ramp section 196*b* that applies a downward pressure to the trailing end portion of pod 46 over the trailing end seal 50. At the trailing end lateral edges of plate section 96*a* is a pair of integrally formed undercurled pivot pin receiving bearings 142 for receiving a complementary pair of inwardly extending pivot pins 144 secured at their outermost ends to the respective body side walls 120.

Pod cover 96 is urged upwardly towards its inoperative position by a pair of upwardly biasing leaf springs 146 having their bottom ends captured in edge slots 148 in body bottom wall 118 and having their upper free ends in bearing relation to the underside of the mid portion of cover plate section 96*a* along its lateral edges, outside of the lateral boundaries of the print sheet position in tray 94.

Figure 4:
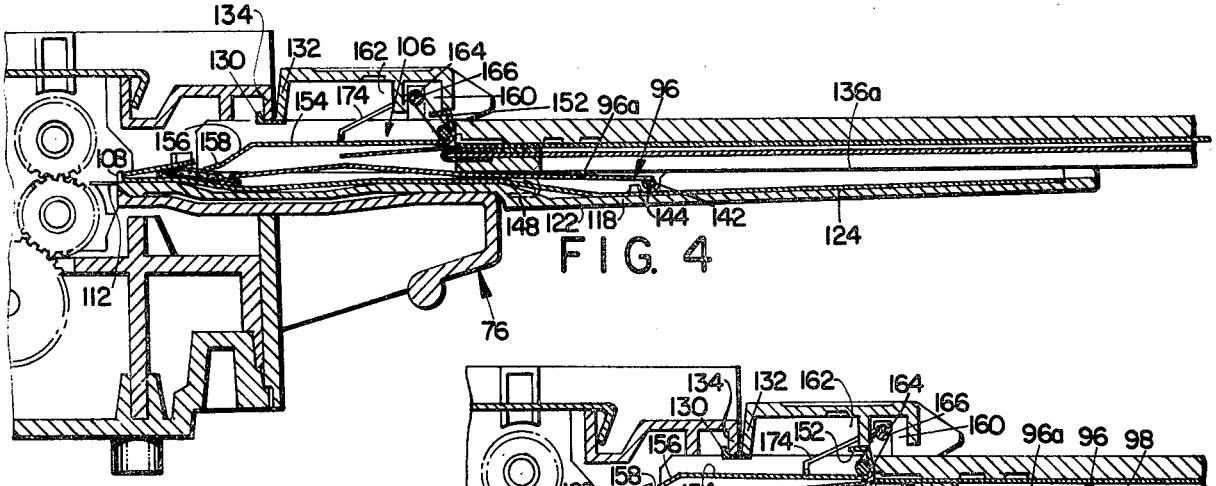
FIG. 4 is a cross-sectional view of the coupling apparatus and a portion of the processor showing the cassette in its initial position in the coupling apparatus.

The flap displacing device 106 is movable from its illustrated storage position in FIG. 3 to an initial position of FIG. 4 when the pod cover 96 is depressed by the weight of the forward end of cassette 14 thereon as shown. From this initial position, the cassette moves device 106 forwardly, as will be described below, so that its leading end is inserted in the tab passageway 54 between the underside of flap 38 and the upper surface 52 of pod 46. In response to further forward movement of the cassette 14 through passage and guide way 104, device 106 moves forwardly in the minimum tab passageway 54 towards the slot 42. Further advancement of cassette 14 causes device 106 to move upwardly under flap 38 thereby raising flap 38 and lifting it away from pod surface 52 to substantially increase the dimension of tab passageway 54 in a direction transverse to the direction of tab travel through passageway 54. With the flap now raised, the underside of device 106 is angled such that it serves as a tab guide surface for deflecting the tab downwardly toward the opened passageway 54. Thus, device 106 serves as both the means for deflecting flap 38 and the means for guiding film sheet tap 26 toward the passageway 54 and the slot 42 at the forward end thereof.

Structurally, device 106 includes a sheet metal displacing member that is approximately one-third of the width of the bridge passageway 104. At the trailing end of the displacing member is an integrally formed L-shaped flange 150 including a vertically disposed and rearwardly facing cassette engagement portion or rear surface 152. Extending forwardly from the bottom of portion 152 is a flat plate-like section 154. Projecting forwardly from the leading end of section 154 is a downwardly inclined tab guide ramp section 156 which is inclined with respect to section 154 at an angle of approximately 30°. Extending forwardly of ramp 156 is a forward or leading end ramp section 158 which is inclined with respect to flat section 154 at an angle of approximately 15°. Ramp section 158 primarily serves as the insertion and flap lifting portion of displacing device 106.

From the motion described, it will be apparent the device 106 is mounted for compound motion, first forwardly and in substantially parallel relation to the flap and then upwardly and substantially perpendicular relation to the flap for lifting purposes in response to linear motion of cassette 14 along the cassette seating means 100.

Displacing device 106 is mounted in the fashion of a pivoting hinge structure. It is mounted in this manner to the underside of the top horizontally disposed portion of bridge 102. For mounting purposes, it will be seen that this portion of bridge 102 is hollow across its width and includes a rear compartment 160 adjacent the trailing end of bridge 102 and a forward compartment 162. These two compartments are seperated by an integrally formed, vertically depending and laterally extending divider wall 163. Integrally formed with and extending rearwardly from divider wall 163 is a pair of laterally spaced flap displacing devices mounting and bearing posts 164 having a pair of inwardly extending mounting pins 166 thereon.

Device 106 is coupled to the pins 166 by means of a pair of pivot links 168. The pins 166 extend through appropriate openings in the upper ends of links 168 and the lower ends of links 168 are provided with inwardly extending link pivot pins 170. The free ends of link pivot pins 170 extend through a pair of integrally formed circular pin receiving bearing members 172 formed on device 106 on the forward side of the intersection of device sections 152 and 154. In a preferred embodiment, displacing device 106 should be biased downwardly slightly to insure that it will descend to the initial position of FIG. 4 after it has been released for descent by the downward movement of pod cover 96 to its operative position. In the illustrated embodiment, the downward biasing means for device 106 is provided by a cantilever spring 1974 located in foward compartment 162 and having its trailing end secured or embedded in divider wall 163 and its free end in engagement with the upper side of device section 154.

Figure 7:
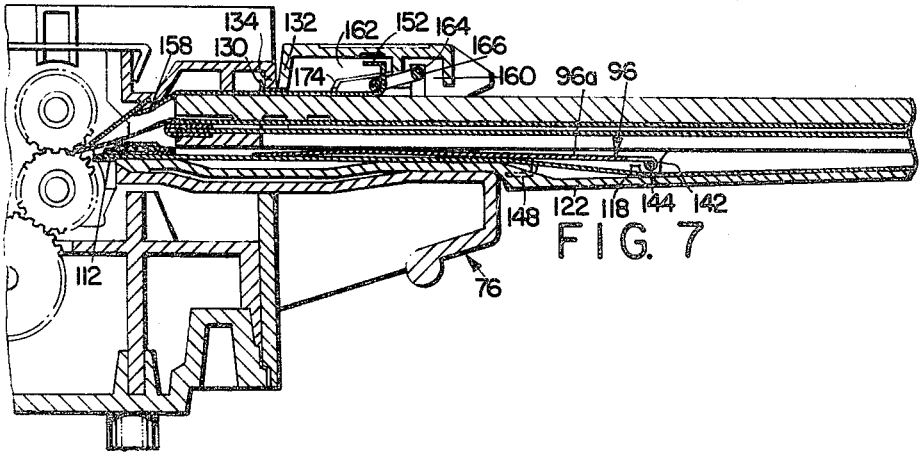
FIG. 7 is similar to FIG. 4 but shows the cassette at its fully inserted position with the film sheet in coupled relation to the print sheet.

As best shown in FIG. 7, the cassette 14 is adapted to finally slide under displacing device section 154 to raise it to its uppermost position. To provide a stop or upper limit for this motion, apparatus 10 is provided with a reference bearing surface 178 which may coincide with the underside of leading end bridge wall 132 in the same plane as the illustrated retaining spring 130. It will be noted that the forward compartment 162 is of sufficient size to receive the flange portion 150 of device 106 along with the lower end of link 168 and the fully compressed biasing spring 174.

The hold back fingers 108 at the leading end of bottom wall 118 each include an integrally formed pivot rod 180 angled downwardly and outwardly toward the forward cassette support rails **136*b*. The pivot rod 180 passes through an integrally formed bearing channel having end openings 182 in the inclined guide ramp 126 at the leading end of tray 94. From the pivot channel, rod 180 passes over the tray defining surface 124 and into a cavity 184 in cassette support rail 136*b* through a communicating opening 186. In cavity 184, the rod 180 terminates in a bent portion defining a cam face of actuator 110 which when engaged by the leading end of the cassette is deflected outwardly causing the rod 180 to pivot to a 90° arc segment thereby causing in the upstanding hold back fingers 108 to pivot 90° so as to assume an unblocking relation to the coupled film and print sheets 12 and 16. This rod and cam structure serves as hold back finger actuating means responsive to engagement by cassette 14 as it approaches its fully inserted position in apparatus 10, defined by cassette stops 116, for moving the restraining or hold back fingers 108 from the blocking position to the unblocking position. When cassette 14 is removed, a biasing spring (not shown) resets the actuator portion to its initial position thereby returning fingers 108** from the unblocking position to the blocking position.

In use, apparatus 10 operates in the following manner. The leading end of apparatus 10, forwardly of bridge 102, is inserted into the entry 18 of processor 20 and is releasably secured thereto in an operative position as previously described.

Prior to insertion of a cassette 14 holding an exposed film sheet 12 therein, the components of apparatus 10 automatically assume the configuration shown in FIG. 3. Pod cover 96 is held up by spring 148 to locate it in inoperative position wherein the leading edge of forward section 96B engages the underside of the guide ramp 156 of the flap displacing device 106 to raise and maintain device 106 in its storage position. The hold back fingers 108 are disposed in an upright blocking position.

A print sheet 16 is inserted, leader end first, under the trailing edge of pod cover section 96A through the trailing end opening 98. The user manually advances print sheet 16 through opening 98 until the leading edge or fold line 40 of print leader 36 abuts against the holding back fingers 108. The trailing end of the print sheet 16 is dropped into the rearward section of tray 94 and transverse rail 140 serves as means for acurately locating and restraining end of the sheet 16. When pod cover 96 is raised, opening 98 is sufficiently dimensioned to permit the easy insertion of the rather thick end of print 16 therethrough. Also, the raised leading end sections of cover 96 and flap displacing device 106 permit this thick leading end of print 16 to be easily moved thereunder to the fully inserted operative position in tray 94.

Cassette 14 is then inserted into the cassette seating means 100 behind bridge 102 with the leading end wall 66 of the cassette facing the bridge guide way 104 and the film sheet leader 24 projecting forwardly out of cassette slot 64. As the cassette 14 is advanced toward the passageway 104, the bottom of the leading end of the cassette engages the raised pod cover section 96A and the weight of the cassette pivots it downwardly against the biasing force of spring 146. Cover 96 pivots down to its operative position and the leading end of section 96B covers the trailing end seal 50 of pod 46 and permit the flap displacing device 106 to pivot downwardly under the influence of spring 174 to its initial position whereby the leading end ramp 158 rests lightly on the upper surface 52 of pod 46 so that the leading edge of ramp 158 is aligned with the tab passageway 54 between the pod and the underside of flap 38. This condition is best shown on FIG. 4 of the drawings. It will be noted that the upper portion of cassette leading wall 66 bears against the cassette engagement portion 152 of device 106 projecting downwardly into the upper part of passageway 104. Also, it will be seen that the projecting film leader 24 easily passes under the flat section 154 of device 106 and is located in a channel defined by the underside of device 106 and the upper surface or side of pod cover 96.

Figure 5:
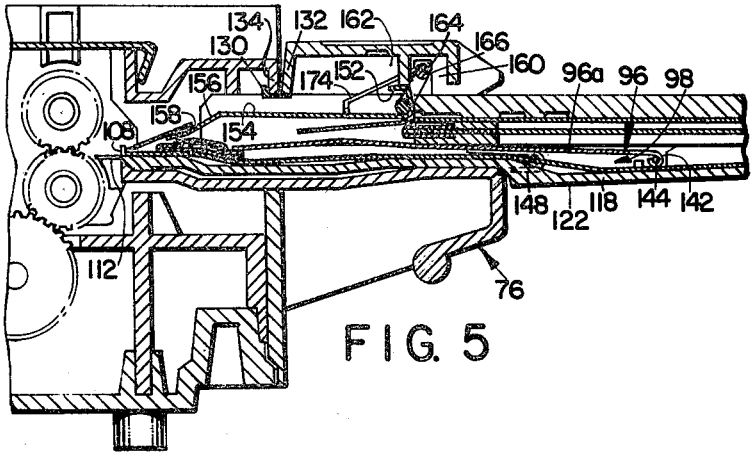
FIG. 5 shows a selection portion of FIG. 4 with the cassette beginning its advance toward the processor.

As cassette 14 is advanced forwardly into the passageway 104, it pushes device 106 forwardly in the hinge pivoting motion previously described whereby the insertion ramp 158 of device 106 is inserted between pod surface 52 and the underside of flap 38. During this insertion phase, it will be noted that the trailing end of device 106 is pivoted by the pivot link suspension system and the trailing end portion 150 actually drops slightly to the bottom of the arc. In FIG. 5, the trailing end 150 of device 106 has passed the low point and has started its upswing toward compartment 162.

Figure 6:
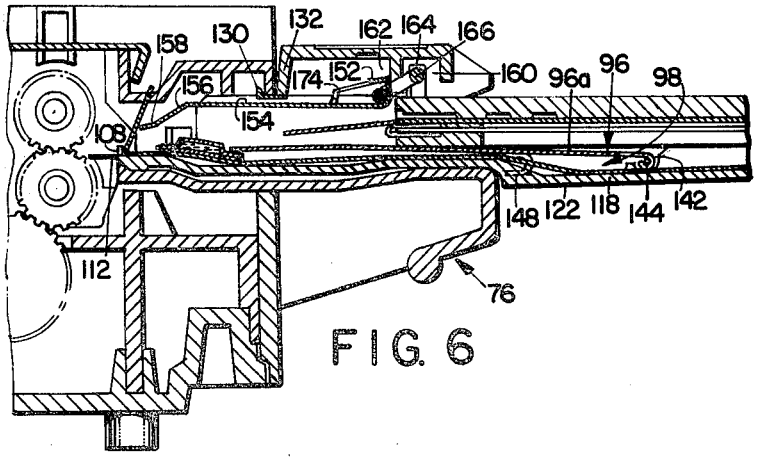
FIG. 6 shows the same portion of FIG. 4 but with the cassette further advanced along its path of travel toward the processor.

As best shown in FIG. 6, continued forward movement of the cassette toward its fully inserted position causes the cassette to advance device 106 toward the leading end of apparatus 10 and the pivoting suspension causes device 106 to rise thereby raising the flap 38 to significantly increase the dimension of the tab passageway 54 and provide a much better access to the tab receiving slot 42 in print leader 36.

As best shown in FIG. 7, continued forward advancement of cassette 14 causes the device 106 to be lifted to its uppermost to terminal position whereupon it is sufficiently high in passageway 104 to allow the cassette to slide under the flat section 154. In this position, the flap 38 is raised to its widest open position and the underside of ramps 156 and 158, preferably along with the forward end of pod cover 96B, serve as guide means for guiding the coupling tab 26 of film sheet 12 through the slot 42 of print leader 36 and therebeyond so that the leading edge of tab 26 is frictionally engaged in the bite line of processor rollers 78 and 80. It will be noted that the tab guide ramp 112 at the leading end of the tray extends almost into the bite line to guide the tap 26 thereinto. Ramp 112 is especially useful in guiding a tab 26 that may have become curled or otherwise distorted through handling. As the cassette 14 approaches its fully inserted position, its leading end wall 66 engages the holdback finger actuators 110 causing the holdback fingers 108 to pivot 90° to the unblocking position.

With the film tab 26 inserted in the bite of the pressure applying rollers, the shoulders 28 of leader 24 abut against that portion of print leader 36 on either side of slot 42 along fold line 40 so as to bring the print sheet 16 and film sheet 12 into positively and fully coupled superposed registered alignment.

The processor motor 84 is energized, either manually or automatically in response to the cassette 14 reaching its fully inserted position and engaging and closing a motor power switch (not shown) in the processor entry 18, causing the rollers 78 and 80 to be driven in a direction to cause the coupled film and print sheets to be advanced therebetween for pressure application.

The rollers advance the coupled sheet elements therebetween thereby releasing the fluid from pod 46 and distributing it in between the image-forming areas of the two sheets. The sheets pass through passageway 86 into chamber 88 in the foldout sheet receiving chamber 90. Thereafter, the film unit is removed from chamber 90 and the film and print sheets are pealed apart to reveal the positive print on sheet 16. The empty cassette 14 may then be withdrawn from apparatus 10 and the component parts thereof automatically returned to the ready position shown in FIG. 3.

Because certain changes may be made in the disclosed photographic apparatus 10 embodying the present invention, and the associated sheet elements 12 and 16 and cassette 14 without departing from the scope of the invention herein involved, it is intended that all matter contained in the above description as shown in the accompanying drawings shall be interpreted as illustrative and not in a limiting sense.

What is claimed is:

1. An improved photographic apparatus for coupling together sheet elements of a self-developing film unit, including a photosensitive image-recording film sheet provided in a cassette and an image-receiving print sheet, and for facilitating the presentation of the coupled film and print sheets to a sheet receiving entry of a self-developing film unit processor, the film sheet being of the type including a film leader, at its forward end, having a forwardly projecting coupling tab thereon, the print sheet being of the type having a print leader, at its forward end, including a print leader flap folded back on the print leader along a forward fold line and terminating rearwardly in an unsecured tailing edge portion and having a tab slot near the fold line for receiving the coupling tab therethrough to bring the film and print sheets into coupled registered relation, the print sheet also being of the type including a rupturable container of processing fluid having leading and trailing edge seals and being longer between these seals than the flap, the container being positioned under the flap with its forward portion, adjacent the leading edge seal, secured to the print leader near the fold line and its trailing end portion unsecured and extending rearwardly on the print leader beyond the trailing edge portion of the flap so that the flap is in proximity to an upper surface of the container whereby the flap and upper surface of the container cooperate to form a tab guide passageway of a minimum dimension therebetween leading to the slot, said apparatus being of the type including a body, means for attaching the body to the processor in an operative position adjacent the entry of the processor, a tray for receiving and supporting a print sheet in general alignment with the entry of the processor, means for engaging the forward edge of the print sheet in the tray to releasably restrain forward movement of the print sheet toward the entry until the print and film sheets are coupled together, cassette seating means for receiving and positioning the cassette at a fully inserted position in general registration with the print sheet in the tray with the tab projecting from a forward end of the cassette and facing the processor entry, and tab guiding means for guiding the film tab through the passageway and tab receiving slot, to effect sheet coupling, and into the processor entry as the cassette approaches its fully inserted position in the cassette seating means wherein the improvement comprises:

means for displacing the print leader flap away from the upper surface of the container of a print sheet in the tray a distance greater than the distance the flap was initially spaced from the upper surface of the container, to define the tab guide passageway of minimum dimension, prior to the insertion of the tab on a film sheet into said passageway to increase the dimension of said passageway in a direction generally transverse to the path of travel of the tab therethrough for facilitating the insertion of the tab into said passageway and through the slot.

2. The improved photographic apparatus of claim 1 wherein said flap displacing means is operative to so displace the flap in response to movement of the cassette along said seating means toward said fully inserted position.

3. The improved apparatus of claim 1 wherein said flap displacing means includes a flap displacing device including a flap engaging portion, said displacing device being mounted for movement on said body for movement between a storage position wherein said flap engaging portion is spaced from the location of the flap of a print sheet supported on said tray to facilitate the introduction of a print sheet onto the tray and a terminal position wherein said flap engaging portion is in engagement with the flap and holds it in a displaced position away from the upper surface of the container to increase the dimensions of the passageway.

4. The improved apparatus of claim 3 wherein said flap displacing device includes a cassette engagement portion configured to be engaged by the cassette for moving said displacing device from an initial position, between said storage and terminal positions, to said terminal position in response to movement of said cassette along said seating means toward said fully inserted position.

5. The improved apparatus of claim 3 wherein said displacing device is mounted for compound movement between said initial and terminal positions so that is moves from said initial position in a direction substantially parallel to the plane of the flap so that the flap engaging portion is inserted between the underside of the flap and the facing upper surface of the container and thereafter is moved in a direction substantially perpendicular to the insertion direction toward said terminal position to lift the flap away from the container upper surface.

6. The improved apparatus of claim 5 wherein said displacing device includes a cassette engagement portion that is engaged by a cassette being moved toward its fully inserted position for moving said displacing device from said initial position to said terminal position with such compound motion.

7. The improved apparatus of claim 1 further including means for releasably maintaining said flap displacing means in said storage position.

8. The improved apparatus of claim 7 wherein said maintaining means includes a rupturable container cover device for covering at least the trailing end portion of the container to block the insertion of the film sheet coupling tab between the underside surface of the container and an underlying facing surface of the print leader.

9. The improved apparatus of claim 8 wherein said cover device is mounted on said body for movement between an inoperative position wherein it is spaced from the location of container of print sheet in said tray to facilitate print sheet loading onto the tray and also wherein said cover device engages said displacing device to releasably maintain it in its said storage position and an operative position wherein said cover device is disengaged from said displacing device thereby unblocking it for movement toward said initial position and also wherein said cover device covers at least the trailing end portion of the container on a print sheet on said tray.

10. The improved photographic apparatus of claim 8 wherein said displacing device and said cover device are configured to be engaged by a cassette moving along said seating means towards said fully inserted position so as to be moved by said cassette, respectively, from said initial to said terminal position and from said inoperative to said operative position.

11. The improved photographic apparatus of claim 10 wherein said cover device and said displacing device are engaged in sequence by said cassette with said cover device being engaged first.

12. The improved photographic apparatus of claim 1 wherein said means for engaging the forward edge of the print sheet in the tray to restrain its forward movement toward the processor entry prior to sheet coupling includes a hold back device mounted on said body for movement between a blocking position wherein it blocks the print sheet path of travel toward the entry and an unblocking position wherein it unblocks the print sheet path of travel, said hold back device being configured to be engaged by and moved from said blocking to said unblocking position by a cassette being moved along said seating means towards said fully inserted position.

13. The improved photographic apparatus of claim 12 wherein said apparatus includes a cassette stop against which the cassette bears to locate it in said fully inserted position and said hold back device includes a hold back actuator located near said stop, said actuator being configured to be engaged by the cassette as it approaches said fully inserted position for operating said hold back device to move it from said blocking to said unblocking position.

14. The improved photographic apparatus of claim 1 wherein said flap displacing means includes a flap displacing device having thereon a tab guide portion that serves as said tab guiding means of said apparatus.

15. An improved photographic apparatus for coupling together sheet elements of a self-developing film unit, including a photosensitive image-recording film sheet provided in a cassette and an image-receiving print sheet, and for facilitating the presentation of the coupled film and print sheets to a sheet receiving entry of a self-developing film unit processor, the film sheet being of the type including a film leader, at its forward end, having a forwardly projecting coupling tab thereon, the print sheet being of the type having a print leader, at its forward end, including a print leader flap folded back on the print leader along a forward fold line and terminating rearwardly in an unsecured tailing edge portion and having a tab slot near the fold line for receiving the coupling tab therethrough to bring the film and print sheets into coupled registered relation, the print sheet also being of the type including a rupturable container of processing fluid having leading and trailing edge seals and being longer between these seals than the flap, the container being positioned under the flap with its forward portion, adjacent the leading edge seal, secured to the print leader near the fold line and its trailing end portion unsecured and extending rearwardly on the print leader beyond the trailing edge portion of the flap so that the flap is in proximity to an upper surface of the container whereby the flap and upper surface of the container cooperate to form a tab guide passageway of a minimum dimension therebetween leading to the slot, said apparatus being of the type including a body, means for attaching the body to the processor in an operative position adjacent the entry of the processor, a tray for receiving and supporting a print sheet in general alignment with the entry of the processor, means for engaging the forward edge of the print sheet in the tray to releasably restrain forward movement of the print sheet toward the entry until the print and film sheets are coupled together, cassette seating means for receiving and positioning the cassette at a fully inserted position in general registration with the print sheet in the tray with the tab projecting from a forward end of the cassette and facing the processor entry, and tab guiding means for guiding the film tab through the passageway and tab receiving slot, to effect sheet coupling, and into the processor entry as the cassette approaches its fully inserted position in the cassette seating means wherein the improvement comprises:

means for covering at least the unsecured trailing end portion of the container of a print sheet in said tray, prior to insertion of the tab into the tab guide passageway, to block the insertion of the tab under the unsecured trailing portion of the container.

16. The improved photographic apparatus of claim 15 wherein said container covering means is movable from a non-covering inoperative position to a covering operative position in response to movement of such a cassette along said cassette seating means towards the cassette's fully inserted position.

17. An improved photographic apparatus for coupling together sheet elements of a self-developing film unit, including a photosensitive image-recording film sheet provided in a cassette and an image-receiving print sheet, and for facilitating the presentation of the coupled film and print sheets to a sheet receiving entry of a self-developing film unit processor, the film sheet being of the type including a film leader, at its forward end, having a forwardly projecting coupling tab thereon, the print sheet being of the type having a print leader, at its forward end, including a print leader flap folded back on the print leader along a forward fold line and terminating rearwardly in an unsecured tailing edge portion and having a tab slot near the fold line for receiving the coupling tab therethrough to bring the film and printsheets into coupled registered relation, the print sheet also being of the type including a rupturable container of processing fluid having leading and trailing edge seals and being longer between these seals than the flap, the container being positioned under the flap with its forward portion, adjacent the leading edge seal, secured to the print leader near the fold line and its trailing end portion unsecured and extending rearwardly on the print leader beyond the trailing edge portion of the flap so that the flap is in proximity to an upper surface of the container whereby the flap and upper surface of the container cooperate to form a tab guide passageway of a minimum dimension therebetween leading to the slot, said apparatus being of the type including a body, means for attaching the body to the processor in an operative position adjacent the entry of the processor, a tray for receiving and supporting a print sheet in general alignment with the entry of the processor, means for engaging the forward edge of the print sheet in the tray to releasably restrain forward movement of the print sheet toward the entry until the print and film sheets are coupled together, cassette seating means for receiving and positioning the cassette at a fully inserted position in general registration with the print sheet in the tray with the tab projecting from a forward end of the cassette and facing the processor entry, and tab guiding means for guiding the film tab through the passageway and tab receiving slot, to effect sheet coupling, and into the processor entry as the cassette approaches its fully inserted position in the cassette seating means wherein the improvement comprises:

said means for releasably restraining movement of the print sheet being configured to include a hold-back device being movable in response to movement of a cassette along said seating means toward said fully inserted position, from a blocking position blocking the path of travel of the print toward the entry to an unblocking position unblocking the print path of travel.

* * * * *